United States Patent [19]

Schiechl

[11] Patent Number: 5,013,040

[45] Date of Patent: May 7, 1991

[54] DICE SET AND METHOD FOR SELECTING A SET OF INTEGERS FOR PLAYING A GAME OF CHANCE

[76] Inventor: John J. Schiechl, 3451 S. Oak Ct., Lakewood, Colo. 80227

[21] Appl. No.: 409,811

[22] Filed: Sep. 20, 1989

[51] Int. Cl.[5] ..... A63F 9/04

[52] U.S. Cl. ..... 273/146; 273/269

[58] Field of Search ..... 273/146, 145 R, 145 A, 273/144 R, 144 A, 144 B, 243-257, 268-270, 93 R

[56] References Cited

U.S. PATENT DOCUMENTS

| | | | |
|---|---|---|---|
| 1,031,157 | 7/1912 | Witt | 273/269 |
| 1,629,661 | 5/1927 | Gerhard | 273/144 R |
| 2,148,102 | 2/1939 | Brumer | 273/146 |
| 4,249,738 | 2/1981 | Troeger | 273/144 B |
| 4,465,278 | 8/1984 | Messina et al. | 273/144 B |
| 4,497,487 | 2/1985 | Crippen | 273/146 |
| 4,533,143 | 8/1985 | Albright et al. | 273/144 B |
| 4,678,190 | 7/1987 | Dery | 273/146 |
| 4,732,387 | 3/1988 | Elinski | 273/144 A |
| 4,741,540 | 5/1988 | Levine | 273/292 |
| 4,757,999 | 7/1988 | Opresco | 273/144 B |

FOREIGN PATENT DOCUMENTS

| | | | |
|---|---|---|---|
| 148995 | 12/1952 | Australia | 273/144 B |
| 1059816 | 6/1959 | Fed. Rep. of Germany | 273/146 |
| 2903796 | 8/1980 | Fed. Rep. of Germany | 273/146 |
| 3509345 | 9/1986 | Fed. Rep. of Germany | 273/141 R |
| 3603302 | 8/1987 | Fed. Rep. of Germany | 273/144 B |
| 2421650 | 12/1979 | France | 273/146 |
| 2442644 | 8/1980 | France | 273/146 |
| 588254 | 5/1977 | Switzerland | 273/146 |

*Primary Examiner*—Edward M. Coven
*Assistant Examiner*—Sebastiano Passaniti
*Attorney, Agent, or Firm*—John R. Flanagan

[57] ABSTRACT

A set of dice are provided for use in selecting a set of integers from a predetermined sequence of different integers. The dice set includes a multiplicity of dice equal in number to the number of integers of the predetermined sequence. Each die has a plurality of exterior faces. Only one exterior face of each die has an integer of the predetermined sequence on it. The other exterior faces of the die are free of integers. In a method of selecting the set of integers, the multiplicity of dice are first shaked and then rolled out onto a surface. Such shaking and rolling of the multiplicity of dice are repeated until only a number of the dice equal to a preset number of integers in the set being selected present their respective one integer-bearing face in the same preselected orientation. The set of integers thusly presented constitutes the selected set of integers.

2 Claims, 1 Drawing Sheet

DICE SET AND METHOD FOR SELECTING A SET OF INTEGERS FOR PLAYING A GAME OF CHANCE

BACKGROUND OF THE INVENTION

1. Field of the Invention

The present invention generally relates to games of chance and, more particularly, is concerned with a dice set and method for selecting a set of integers.

2. Description of the Prior Art

Lotteries are presently very popular across the United States, especially those games in which a player selects a small set of numbers or integers from a predetermined large sequence of integers. For example, in the lottery game of one state the highest integer of the predetermined sequence might be 36, whereas in the lottery game of another state the highest integer of the sequence might be 44. The player is typically required to pick a set of six different integers from the predetermined sequence of integers.

Different devices for assisting players in integer selection, for playing lotteries and other games of chance, are known in the prior art. Some representative prior art devices are those disclosed in Messina et al U.S. Pat. No. 4,465,278, Crippen U.S. Pat. No. 4,497,487, Dery U.S. Pat. No. 4,678,190 and Levine U.S. Pat. No. 4,741,540, and foreign patents to Vaterlaus (Swiss 588,254), Becker (German 1,059,816), viala (French 2,421,650), Ortiz (French 2,442,644), Schlopsna (German 2,903,796) and Filmosto-Projektion (German 3,509,345). The U.S. patents to Crippen and Dery and the foreign patents to Vaterlaus, Becker, Viala, Ortiz and Schlopsna disclose different dice sets. The dice of all sets but those of Vaterlaus and Dery have different non-cubic face arrangements. The latter two have cubic face arrangements but with different integer patterns. In all dice sets, each individual die contains more than one integer.

Use of dice in selecting a set of lottery integers would seem to have an inherent appeal to a large segment of lottery players for a number of reasons. On the one hand, many lottery players are probably attracted by the gambling element of lotteries. These players are familiar and comfortable with using dice in other forms of gambling. On the other hand, other lottery players may be responding to the recreational element of lotteries. These players are familiar and comfortable with the use of dice in number and turn selection in many recreational games.

Also, dice have several advantages over other methods of integer selection, such as playing cards, which might be used. Shaking and rolling of dice probably can be accomplished repetitively more quickly than shuffling and drawing cards from a deck. Dice probably are capable of selecting a number in a more random and objective way and are less susceptible to a player inadvertently biasing the selection process than if playing cards are employed.

As the diversity of prior art dice sets of the above-identified patents demonstrates, much thought and effort has gone into devising a dice set that will accomplish the dual objective of permitting the player to have fun while, at the same time, objectively and randomly selecting a set of lottery integers or numbers.

However, the main drawbacks of the above-described dice sets are that they are overly complex in appearance, unnecessarily complicated to use, and too expensive to fabricate. Consequently, a different approach is needed to make the use of dice more appealing and practical in the selection of lottery numbers or integers.

SUMMARY OF THE INVENTION

The present invention provides a dice set and method for multiple integer selection designed to satisfy the aforementioned needs. The dice set of the present invention is relatively inexpensive to fabricate compared with the prior art dice sets. The integer selection method of the present invention which uses this dice set is relatively simple and straightforward to grasp and use.

The dice set is particularly suited for use in selecting a set of integers for playing lotteries. However, the present invention is not so limited in its potential applications. It can be used in other games of chance, such as keno.

Accordingly, the present invention is directed to a dice set for use in selecting a set of integers from a predetermined sequence of different integers. The integers in the set are different from one another and are a preset number fewer than the number of integers in the predetermined sequence. The dice set comprises a multiplicity of dice equal in number to the number of integers of the predetermined sequence. Each die has a plurality of exterior faces. Only one exterior face of each die has an integer of the predetermined sequence on it. The other exterior faces of the die are free of integers.

Preferably, each die of the multiplicity thereof is cubic shaped, has six faces, and has only one integer on one of the six faces. The remaining five faces do not bear integers and are preferably blank.

Also, the present invention is directed to a method of selecting the set of integers from the predetermined sequence of different integers. The selecting method comprises the steps of: (a) providing a multiplicity of dice equal in number to the number of integers in the predetermined sequence with each die having a plurality of exterior faces but only one face bearing an integer of the predetermined sequence thereon, the other faces being free of integers; (b) shaking the multiplicity of dice; (c) rolling the multiplicity of dice onto a surface; and (d) repeating the shaking and rolling of the multiplicity of dice until only a number of the dice equal to the preset number of integers in the set being selected present their respective integer-bearing faces in the same preselected orientation. The set of integers thusly presented constitutes the selected set of integers to be used, for example, in playing a lottery game.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
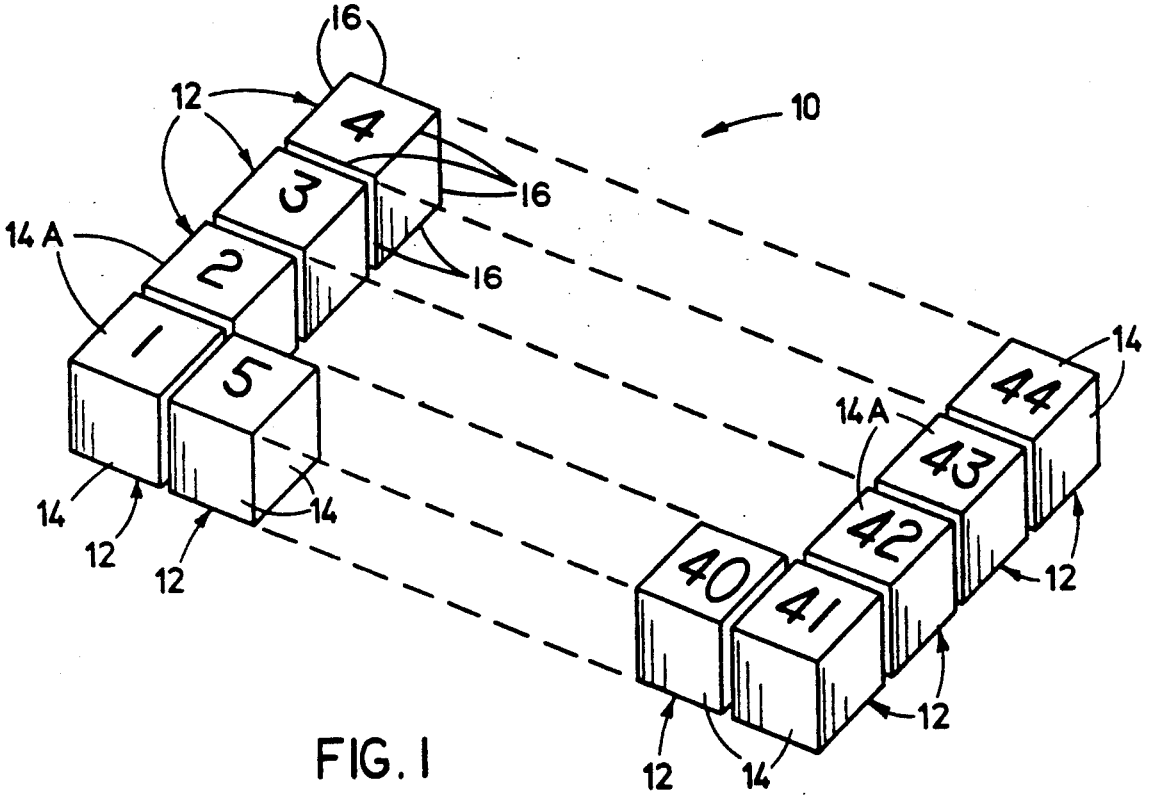
FIG. 1 is a perspective view of a dice set in accordance with the present invention.

Referring to the drawings, and particularly to FIG. 1, there is shown a dice set, generally designated by the numeral 10, constructed in accordance with the present invention for use in selecting a set of integers from a predetermined sequence of different integers. In one application of the present invention, the dice set 10 is used to select a set of integers of a preset number, for example six, for playing a conventional lottery game wherein integers will be drawn from a predetermined maximum sequence of different integers, for example forty-four in number ranging from the integers one to forty-four, as prescribed by the lottery game rules.

The integers in the set are different from one another and are a preset number fewer than the number of integers in the predetermined sequence. The dice set 10 is composed of a multiplicity of dice 12 equal in number to the number of integers of the predetermined sequence. Each die 12 has a plurality of exterior faces 14. Each face 14 of a given die 12 has a multiplicity of interconnected peripheral edges 16 which are shared with adjacent faces 14 of the die 12. Only one exterior face 14A of each die 14 has an integer of the predetermined sequence on it. The other exterior faces 14 of the die 12 are free of integers. They do not bear integers and are preferably blank. As can be readily understood from FIG. 1, each die 12 is identical to one another and the exterior shape of each die 12 is symmetrical from one exterior face to the next about the center of the die 12, permitting the die 12 when rolled on a flat surface to have an equal probability of coming to rest on any of its exterior faces 14.

Figure 2:
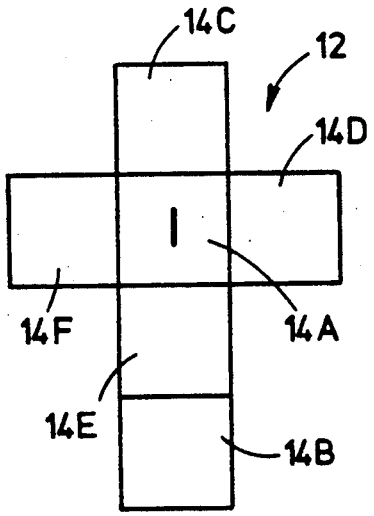
FIG. 2 is a plan view of the faces of one die of the dice set of FIG. 1, illustrating the die having, on one face only, the smallest number in a predetermined sequence of different numbers on the dice of the set.
Figure 3:
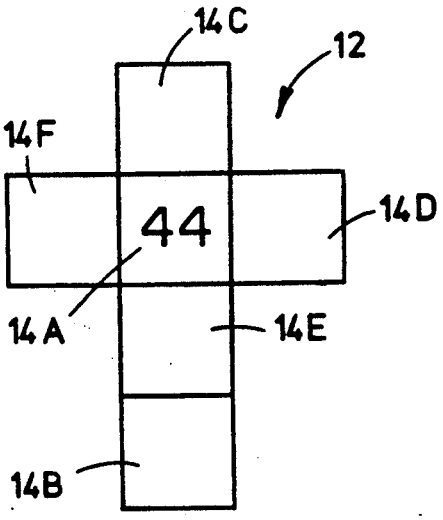
FIG. 3 is a plan view of the faces of another die of the dice set of FIG. 1, illustrating the die having, on one face only, the largest number in the predetermined set of different numbers on the dice of the set.

Referring to FIGS. 2 and 3, preferably, each die 12 of the multiplicity thereof is cubic shaped and has six faces 14. Considering the two dice 12 shown in plan views in FIGS. 2 and 3 in their orientation shown in FIG. 1, they have top and bottom faces 14A and 14B and four side faces 14C, 14D, 14E and 14F. They each only have one integer on one of the six faces 14. In the orientations of the dice of the set 10 shown in FIG. 1, the integers are on the respective top faces 14A of the dice 12.

In one example of the dice set 10, each face 14 of the die 12 is a $\frac{3}{8}$ inch square. Each die 12 is made from extruded aluminum. Alternatively, the dice 12 can be fabricated from a suitable plastic material. The integers can be stamped on the dice in a conventional manner. Preferably, eighty dice bearing a sequence integers from 1 to 80 would be sold with a cup to use for holding and shaking the dice. Eighty dice would be used for the game of keno. If the predetermined sequence of integers used in a particular lottery game is only 36 or 44, for instance, then only the dice bearing integers 1 to 36 or 1 to 44 would be used by the player.

The primary application envisioned for the abovedescribed dice set 10 is to assist a lottery player in selecting the small set of integers for playing the lottery game from the larger predetermined sequence of different integers prescribed by the lottery game rules. In a method, of selecting the set of lottery numbers or integers in, the player first shakes the multiplicity of dice 12 in his or her cupped hands or in a cup and then rolls the dice onto a flat surface, such as, of a table. The shaking and rolling of the dice 12 are repeated until only a number of the dice 12 equal to the preset number of integers in the set selected for playing the particular lottery game are resting on the surface with their respective integer-bearing faces 14A, as seen in FIG. 1, presented in the same preselected orientation, such as facing up. The set of integers thusly presented by the required number of dice 12 constitutes the selected set of integers. For example, in a lottery game requiring the selection of six numbers or integers to play the game, the dice 12 would be repeatedly shaked and rolled until only six of the dice 12 resting on the surface have their integer-bearing face 14A oriented as the top face.

In summary, it can be readily understood that in using the dice set 10 described above to select lottery numbers, there is present the same elements of luck, random choosing, gambling, supersitition, etc., that the lottery game has in itself. Additionally, the dice set 10 can be used for any other type of gambling game where a set of numbers or integers have to be picked or selected, such as keno, horse racing, dog racing and the like.

It is thought that the present invention will be understood from the foregoing description and it will be apparent that various changes may be made thereto without departing from its spirit and scope or sacrificing all of its material advantages, the form hereinbefore described being merely preferred or exemplary embodiment thereof.

Having thus described the invention, what is claimed is:

1. A method of selecting a set of integers from a predetermined sequence of different integers wherein said integers in said predetermined sequence are different from one another and said integers in said integer set are different from one another and a preset number fewer than the number of integers in said predetermined sequence, said method comprising the steps of:

(a) providing a multiplicity of dice equal in number to the number of integers in the predetermined sequence with each die having a plurality of exterior faces but only one face bearing an integer of the predetermined sequence thereon, the other faces being free of integers, each said exterior face of each die having a multiplicity of interconnected peripheral edges be shared with said exterior faces adjacent thereto, each die being identical to one another and having an exterior shape being symmetrical from one exterior face to the next permitting the die when rolled on a flat surface to have an equal probability of coming to rest on any of said exterior faces;

(b) shaking the multiplicity of dice;

(c) rolling the multiplicity of dice onto a surface; and (d) repeating said shaking and rolling of the multiplicity of dice until, in a single rolling of the dice, only a number of the dice equal to the preset number of integers in the set being selected present their respective one integer-bearing face in the same preselected orientation, the set of integers thusly presented constituting the selected set of integers.

2. The method of claim 1 wherein said preselected orientation is the one where said integer-bearing die face is directed upwardly.

* * * * *